US008235770B2

(12) United States Patent
Obayashi

(10) Patent No.: US 8,235,770 B2
(45) Date of Patent: Aug. 7, 2012

(54) EYEGLASS LENS PROCESSING APPARATUS

(75) Inventor: Hirokatsu Obayashi, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 318 days.

(21) Appl. No.: 12/323,684

(22) Filed: Nov. 26, 2008

(65) Prior Publication Data

US 2009/0142993 A1 Jun. 4, 2009

(30) Foreign Application Priority Data

Nov. 30, 2007 (JP) ..... 2007-311230

(51) Int. Cl.
*B24B 49/00* (2006.01)
*G06F 19/00* (2006.01)

(52) U.S. Cl. ..... 451/43; 700/172; 700/187

(58) Field of Classification Search ..... 700/117, 700/159, 160, 170, 172, 173, 179, 180, 182, 700/187, 275; 451/5, 8, 9, 43, 178
See application file for complete search history.

(56) References Cited

U.S. PATENT DOCUMENTS

| | | | | |
|---|---|---|---|---|
| 5,333,412 | A | 8/1994 | Matsuyama | |
| 5,347,762 | A | 9/1994 | Shibata et al. | |
| 5,450,335 | A * | 9/1995 | Kikuchi | 451/256 |
| 5,485,399 | A * | 1/1996 | Saigo et al. | 345/420 |
| 6,089,957 | A | 7/2000 | Shibata | |
| 6,290,569 | B1 * | 9/2001 | Mizuno et al. | 451/5 |
| 6,328,628 | B1 * | 12/2001 | Mizuno et al. | 451/5 |
| 6,409,574 | B1 * | 6/2002 | Shibata | 451/5 |
| 6,568,990 | B2 * | 5/2003 | Siders et al. | 451/5 |
| 6,623,339 | B1 * | 9/2003 | Igarashi et al. | 451/42 |
| 6,887,134 | B2 * | 5/2005 | Jinbo et al. | 451/43 |
| 2003/0087584 | A1 | 5/2003 | Shibata | |
| 2003/0227690 | A1 * | 12/2003 | Jinbo et al. | 451/43 |
| 2005/0009455 | A1 * | 1/2005 | Jinbo et al. | 451/5 |
| 2006/0240747 | A1 * | 10/2006 | Natsume et al. | 451/5 |
| 2007/0202775 | A1 * | 8/2007 | Shibata | 451/5 |

FOREIGN PATENT DOCUMENTS

| | | | |
|---|---|---|---|
| EP | 1510290 | A1 | 3/2005 |
| JP | 04-093164 | A | 3/1992 |
| JP | 5-212661 | A | 8/1993 |
| JP | 11-48113 | A | 2/1999 |
| JP | 2003-145328 | A | 5/2003 |
| JP | 2004-74346 | A | 3/2004 |
| JP | 2005-74560 | A | 3/2005 |

* cited by examiner

*Primary Examiner* — Charles Kasenge
(74) *Attorney, Agent, or Firm* — Sughrue Mion, PLLC

(57) ABSTRACT

An eyeglass lens processing apparatus includes: a processing tool which processes a peripheral edge of the lens and includes a roughing tool, a beveling tool and a bevel-modifying tool; a selection unit which is used to select a high curve beveling mode for forming a bevel in the lens fitted into a high curve frame having a protrusion portion; a modifying portion data input unit inputs data of a portion to be modified so as to prevent an interference between the lens and the protrusion portion; a calculation unit which obtains bevel-modifying data on the basis of a bevel path and data of the modifying portion; and a processing control portion which performs the beveling to the lens by the beveling tool in accordance with the beveling data, and removes a part of the bevel shoulder and/or the bevel slope by the bevel-modifying tool in accordance with the bevel-modifying data.

5 Claims, 12 Drawing Sheets

EYEGLASS LENS PROCESSING APPARATUS

BACKGROUND OF THE INVENTION

The present invention relates to an eyeglass lens processing apparatus for processing a peripheral edge of an eyeglass lens.

A high curve frame having large curvature has been mainly used for sunglasses, but a demand for using a corrective lens together with the high curve frame has been increased. Since it is necessary to use an eyeglass lens having large curvature in case of fitting a lens into the high curve frame, it is desirable to form a high curve bevel in the peripheral edge of the lens so as to correspond to the curvature of the frame. As a method of forming a high curve bevel while restricting bevel thinning (a phenomenon in which a width or a height of the bevel becomes small), a method of separately processing a front slope and a rear slope of a bevel is disclosed (Japanese Patent Application Laid-Open No. H11-48113 (U.S. Pat. No. 6,089,957)), and a method of forming a bevel using a beveling grindstone having a diameter smaller than that of a large-diameter beveling grindstone used for a general beveling is disclosed (Japanese Patent Application Laid-Open No. 2004-74346 and Japanese Patent Application Laid-Open No. 2005-74560 (EP 1510290A1)).

Incidentally, in some cases, the high curve frame mainly used for the sunglasses is provided with a portion in which a side wall Fb formed on a rear surface side of the lens is larger than a side wall Fa formed on a front surface side of the lens as shown in FIG. 7 (hereinafter, the large portion formed on the rear surface side of the lens is referred to as a protrusion portion BH) in order to prevent the lens from being slipped out in a direction toward the rear surface side of the lens. Since the sunglass lens is thin, it is possible to directly fit the lens into the frame by forming the bevel in the peripheral edge of the lens. However, in case of forming the bevel in the corrective lens, since the lens is thick, it is not possible to fit the lens into the high curve frame having the protrusion portion BH just by forming the bevel in the general method. In this case, in order to cope with this situation, the rear surface side of the bevel may be manually cut out by a tool such as a reamer. However, it takes particular skill and much processing time to carry out the processing.

SUMMARY OF THE INVENTION

A technical object of the invention is to provide an eyeglass lens processing apparatus capable of easily carrying out a processing, in which a corrective lens is fitted into a high curve frame having a protrusion portion on a rear surface side of the lens, without operator's particular skill.

In order to achieve the object, the present invention provides the following arrangements.

(1) An eyeglass lens processing apparatus comprising:

a lens chuck shaft which holds and rotates an eyeglass lens;

a lens edge position detection unit which detects edge positions of a front surface and a rear surface of the lens on the basis of target lens shape data;

a processing tool which processes a peripheral edge of the lens and includes a roughing tool, a beveling tool and a bevel-modifying tool, the bevel-modifying tool including a grindstone or a cutter and removing a part of a bevel shoulder and/or a bevel slope on the rear surface side of the lens subjected to beveling;

a selection unit which is used to select a processing mode including a high curve beveling mode for forming a bevel in the lens fitted into a high curve frame having a protrusion portion in which a side wall of the frame on the rear surface side of the lens is larger than a side wall of the frame on the front surface side of the lens;

a modifying portion data input unit which is used to input data of a portion to be modified in a region of the bevel slope and/or the bevel shoulder so as to prevent an interference between the lens and the protrusion portion of the high curve frame, and includes a display and an input unit used for inputting data in accordance with and a screen on the display, or a receiving unit for receiving data of the protrusion portion of the high curve frame;

a calculation unit which obtains a bevel path of the bevel to be formed in the peripheral edge of the lens on the basis of the edge positions of the front surface and the rear surface of the lens obtained by the edge position detection units, obtains beveling data for the beveling tool, and obtains bevel-modifying data for the bevel-modifying tool on the basis of the bevel path and the data of the modifying portion, in the high curve beveling mode; and a processing control unit which performs the beveling to the peripheral edge of the lens by the beveling tool in accordance with the beveling data, and removes a part of the bevel shoulder and/or the bevel slope on the rear surface side of the lens by the bevel-modifying tool in accordance with the bevel-modifying data.

(2) The eyeglass lens processing apparatus according to (1), wherein the modifying portion data input unit includes a screen used to input data in a depth and a distance in a direction toward the rear surface side of the lens of the modifying portion with respect to a bevel top point formed in the lens.

(3) The eyeglass lens processing apparatus according to (1), wherein the bevel-modifying tool includes a chevron shape processing tool which includes a first processing surface for forming a part of the modifying portion in the lens so as to be substantially perpendicular to the lens chuck shaft and a second processing surface for forming a part of the modifying portion in the lens so as to be substantially parallel to the lens chuck shaft.

(4) The eyeglass lens processing apparatus according to (1), further comprising a grooving tool for forming a groove in the peripheral edge of the lens or a drilling tool for drilling a refractive surface of the lens, wherein the grooving tool or the drilling tool is used as the bevel-modifying tool.

DETAILED DESCRIPTION OF PREFERRED EMBODIMENTS

Figure 1:
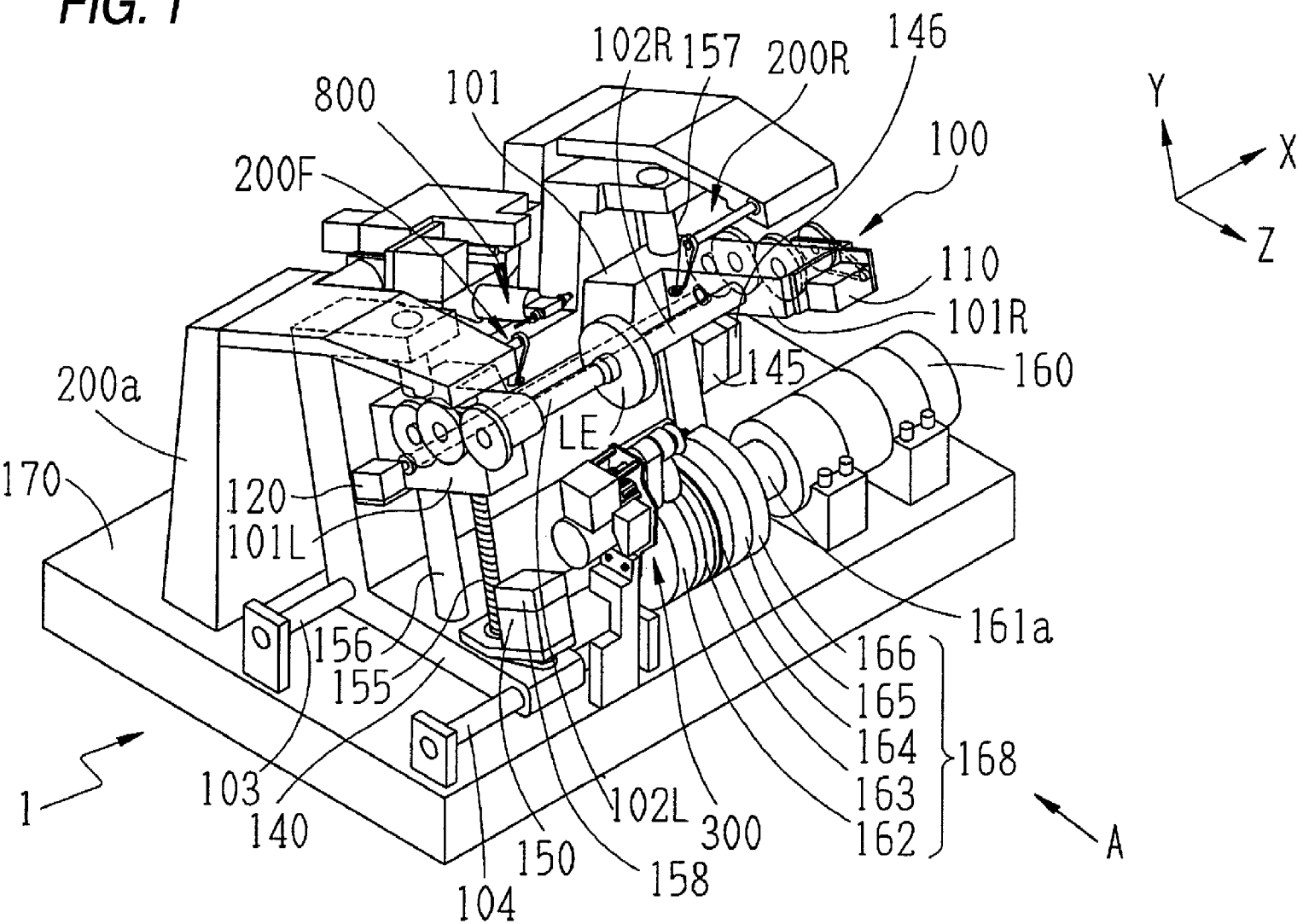
FIG. 1 is a schematic diagram showing a processing mechanism of an eyeglass lens processing apparatus.

Hereinafter, an exemplary embodiment of the invention will be described with reference to the accompanying drawings. FIG. 1 is a schematic configuration diagram showing a processing mechanism of an eyeglass lens processing apparatus according to the invention.

A carriage portion 100 is mounted onto a base 170 of a processing device body 1. An eyeglass lens LE to be processed is held (chucked) by lens chuck shafts (lens rotating shafts) 102L, 102R of a carriage 101, and a peripheral edge of the lens is pressed and processed by a grindstone group 168 coaxially attached to a grindstone spindle 161*a*. The grindstone group 168 includes a roughing grindstone 162 for a glass, a high curve bevel-finishing (beveling) grindstone 163 having a bevel slope to form a bevel in a high curve lens, a finishing grindstone 164 having a V groove (bevel groove) VG to form a bevel in a low curve lens and a flat processing surface, a flat polishing grindstone 165, and a roughing grindstone (roughing tool) 166 for plastic. The grindstone spindle 161*a* is rotated by a motor 160.

The lens chuck shaft 102L is held by a left arm 101L of the carriage 101 and the lens chuck shaft 102R is held by a right arm 101R of the carriage 101 rotatably and coaxially. The lens chuck shaft 102R is moved toward the lens chuck shaft 102L by a motor 110 attached to the right arm 101R, and the lens LE is held by the two lens chuck shafts 102R and 102L. Further, the two lens chuck shafts 102R and 102L are rotated in synchronization with each other by a motor 120 attached to the left arm 101L through a rotation transmission mechanism such as a gear. Accordingly, a lens rotating mechanism is configured in this manner.

The carriage 101 is mounted on a movement support base 140 capable of moving in an X-axis direction along shafts 103 and 104 extending in parallel to the lens chuck shafts 102R, 102L and the grindstone spindle 161*a*. A ball screw (not shown) extending in parallel to the shaft 103 is attached to the rear portion of the support base 140, and the ball screw is attached to a rotating shaft of an X-axis movement motor 145. By the rotation of the motor 145, the carriage 101 as well as the support base 140 is linearly moved in an X-axis direction (an axial direction of the lens chuck shaft). Accordingly, these components constitute an X-axis direction movement unit. The rotating shaft of the motor 145 is provided with an encoder 146 for detecting the X-axis direction movement of the carriage 101.

The support base 140 is fixed with shafts 156 and 157 extending in a Y-axis direction (a direction in which the axis-to-axis distance between the lens chuck shafts 102R, 102L and the grindstone spindle 161*a* is changed). The carriage 101 is mounted on the support base 140 so as to be movable in a Y-axis direction along the shafts 156 and 157, A Y-axis movement motor 150 is fixed to the support base 140. The rotation of the motor 150 is transmitted to a ball screw 155 extending in a Y-axis direction, and the carriage 101 is moved in a Y-axis direction by a rotation of the ball screw 155. Accordingly, a Y-axis movement unit is configured in this manner. A rotating shaft of the motor 150 is provided with an encoder 158 as a detector for detecting a movement of the carriage 101 in a Y-axis direction.

Figure 2:
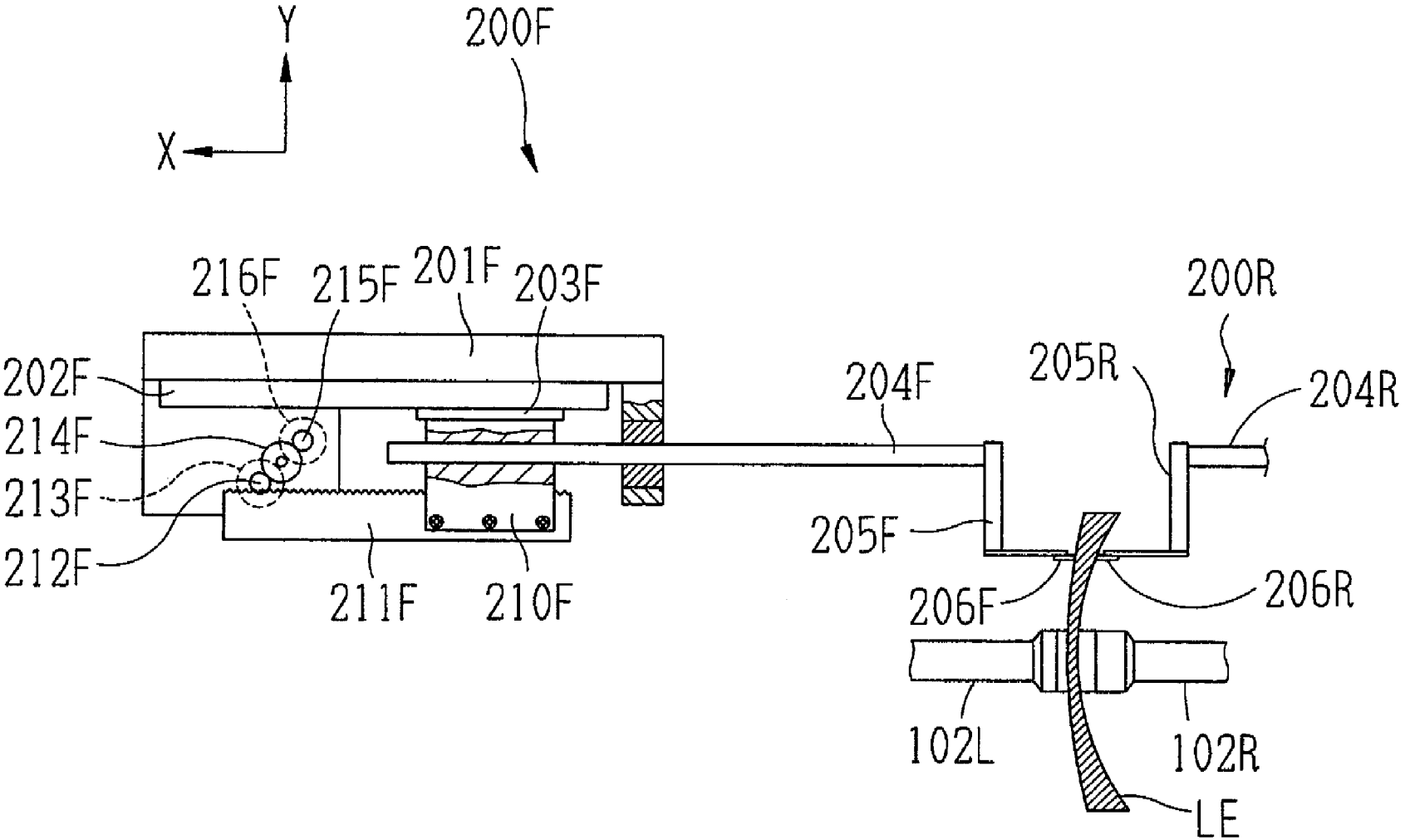
FIG. 2 is a schematic diagram showing a lens edge position measurement portion.

In FIG. 1, lens edge position measurement portions (a lens edge position detection unit) 200F and 200R are provided above the carriage 101. FIG. 2 is a schematic diagram showing the measurement portion 200F for measuring a lens edge position of a front surface of the lens. An attachment support base 201F is fixed to a support base block 200*a* fixed to a base 170 shown in FIG. 1, and a slider 203F is slidably attached to a rail 202F fixed to the attachment support base 201F. A slide base 210F is fixed to the slider 203F, and a measurement arm 204F is fixed to the slide base 210F. An L-shape hand 205F is fixed to a front end portion of the measurement arm 204F, and a measurement portion 206F is fixed to a front end portion of the hand 205F. The measurement portion 206F makes contact with a front-side refractive surface of the lens LE.

A rack 211F is fixed to a lower end portion of the slide base 210F. The rack 211F meshes with a pinion 212F of an encoder 213F fixed to the attachment support base 201F. A rotation of a motor 216F is transmitted to the rack 211F via a gear 215F, an idle gear 214F, and the pinion 212F, thereby moving the slide base 210F in an X-axis direction. During the measurement of the lens edge position, the motor 216F presses the measurement portion 206F against the lens LE at the same force all the time. The pressing force of the measurement portion 206F applied from the motor 216F to the lens refractive surface is set to a small force in order to prevent a scratch of the lens refractive surface. As means for applying a pressing force of the measurement portion 206F against the lens refractive surface, pressure applying device such as a spring may be employed. The encoder 213F detects the movement position of the measurement portion 206F in an X-axis direction by detecting the movement position of the slide base 210F. On the basis of the movement position information, the rotating angle information of the lens chuck shafts 102L, 102R, and the Y-axis movement information, the edge position of the front surface of the lens LE (and the lens front surface position) is measured.

Since a configuration of the measurement portion 200R for measuring the edge position of a rear surface of the lens LE is symmetric to the configuration of the measurement portion 200F, "F" of the reference numerals given to the components of the measurement portion 200F shown in FIG. 2 is exchanged with "R", and the description thereof will be omitted.

During the measurement of the lens edge position, the measurement portion 206F comes into contact with the front surface of the lens, and the measurement portion 206R comes into contact with the rear surface of the lens. When the carriage 101 is moved in a Y-axis direction and the lens LE is rotated on the basis of lens shape data (target lens data) in this state, the edge positions of the front surface and the rear surface of the lens are measured for processing a peripheral edge of the lens.

Figure 3:
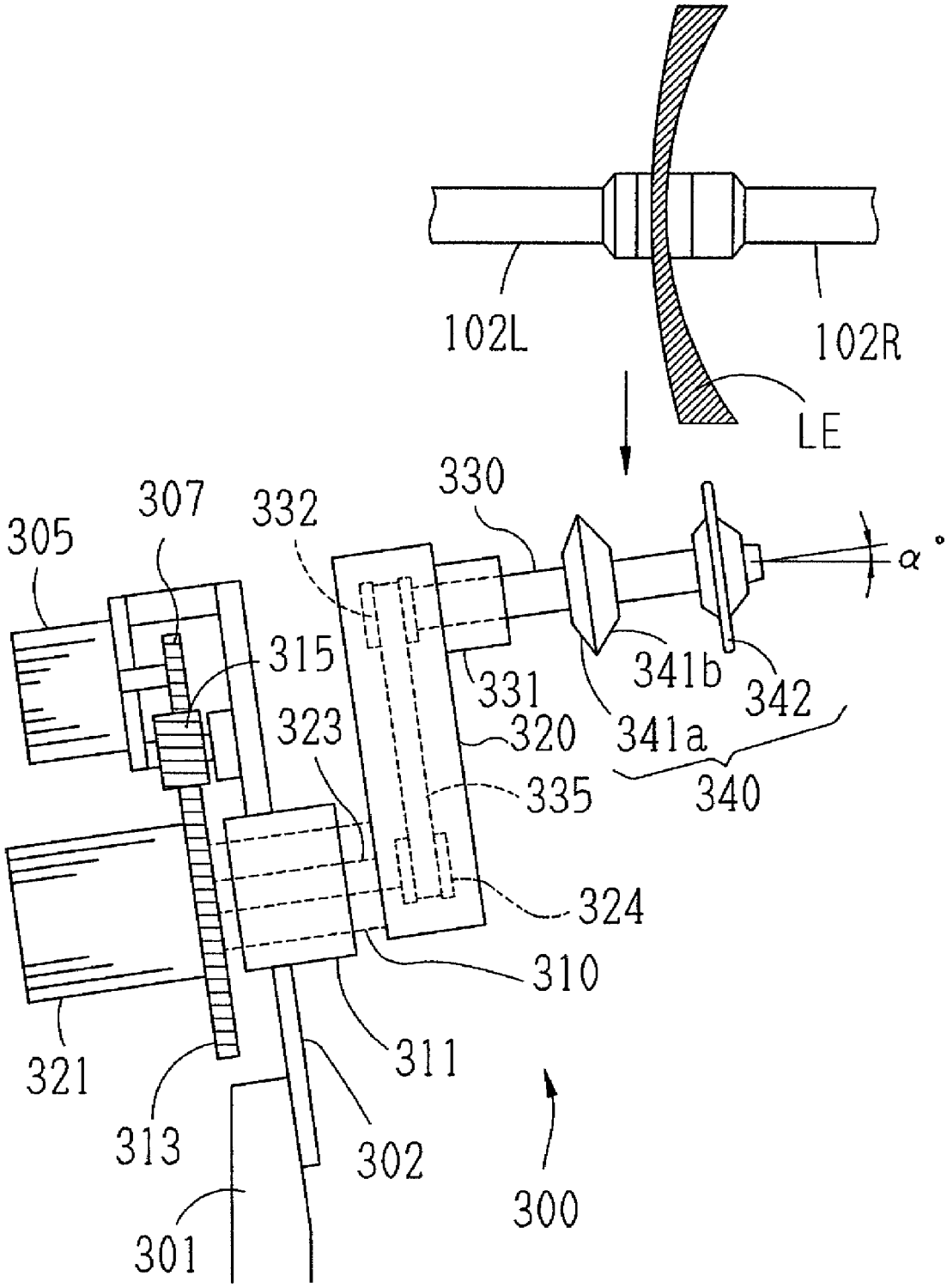
FIG. 3 is a schematic diagram showing a chamfering-grooving mechanism portion.

In FIG. 1, a chamfering-grooving mechanism portion 300 is disposed in front of the carriage portion 100. The mechanism portion 300 is also used as a bevel-modifying mechanism portion for partially removing a lower portion (and a bevel shoulder on the rear surface side of the lens) of a bevel slope on the rear surface side of the lens. FIG. 3 is a schematic configuration diagram showing the mechanism part 300. A fixed plate 302 is fixed to the support base block 301 on the base 170. A pulse motor 305 for rotating an arm 320 so as to move a grindstone portion 340 between a processing position and a retraction position is fixed to a position above the fixed plate 302. A hold member 311 for rotatably holding an arm rotating member 310 is fixed to the fixed plate 302, and a large gear 313 is fixed to the arm rotating member 310 extending up to the left side of the fixed plate 302. A gear 307 is attached to a rotating shaft of the pulse motor 305, and a rotation of the gear 307 generated by the pulse motor 305 is transmitted to the large gear 313 via an idle gear 3151 thereby rotating the arm 320 fixed to the arm rotating member 310.

A grindstone rotating motor 321 is fixed to the large gear 313, and the motor 321 is rotated together with the large gear 313. A rotating shaft of the motor 321 is connected to a shaft 323 rotatably held in the inside of the arm rotating member 310. A pulley 324 is attached to an end of the shaft 323 extending up to the inside of the arm 320. A hold member 331 for rotatably holding a grindstone spindle 330 is fixed to a front end of the arm 320. A pulley 332 is attached to a left end of the grindstone spindle 330. The pulley 332 is connected to the pulley 324 by a belt 335, thereby transmitting a rotation of the motor 321 to the grindstone spindle 330. The grindstone spindle 330 is attached with a lens-rear-surface chamfering grindstone 341*a*, a lens-front-surface chamfering grindstone 341*b*, and a grooving grindstone 342 as a grooving tool. The grooving grindstone 342 is also used as a processing tool for bevel-modifying the lower portion of the slope on the rear surface side of the bevel. The grindstone spindle 330 is disposed so as to be inclined at an angle α (for example, the angle α is 8°) with respect to an axial direction of the lens rotating shafts 102L and 102R, thereby easily carrying out the grooving using the grooving grindstone 342 along the lens curve. The chamfering grindstone 341*a*, the chamfering grindstone 341*b*, and the grooving grindstone 342 are formed in a circular shape, and an outer-diameter dimension is about 30 mm.

During the grooving and the chamfering, the arm 320 is rotated by the pulse motor 305, and the grindstone portion 340 is moved from the retraction position to the processing position. The processing position of the grindstone portion 340 corresponds to a position in which the grindstone spindle 330 is located between the lens rotating shafts 102L, 102R and the grindstone spindle 161*a* on a plane where the lens rotating shafts 102L, 102R and the grindstone spindle 161*a* are located. Accordingly, in the same manner as the lens peripheral edge processing by the grindstone group 168, it is possible to change a distance between the lens rotating shafts 102L, 102R and the rotating shaft 330 by the motor 150.

A drilling mechanism portion 800 is disposed in rear of the carriage portion 100.

Further, X-axis movement unit and Y-axis movement unit of the eyeglass lens processing apparatus shown in FIG. 1 may be configured such that the grindstone spindle 161*a* is relatively moved in an X-axis direction and a Y-axis direction with respect to the lens chuck shaft (102L and 102R). Furthermore, the lens edge position measurement portions 200F and 200R may be configured such that the measurement portions 206F and 206R are moved in a Y-axis direction with respect to the lens chuck shaft (102L and 102R).

Figure 4:
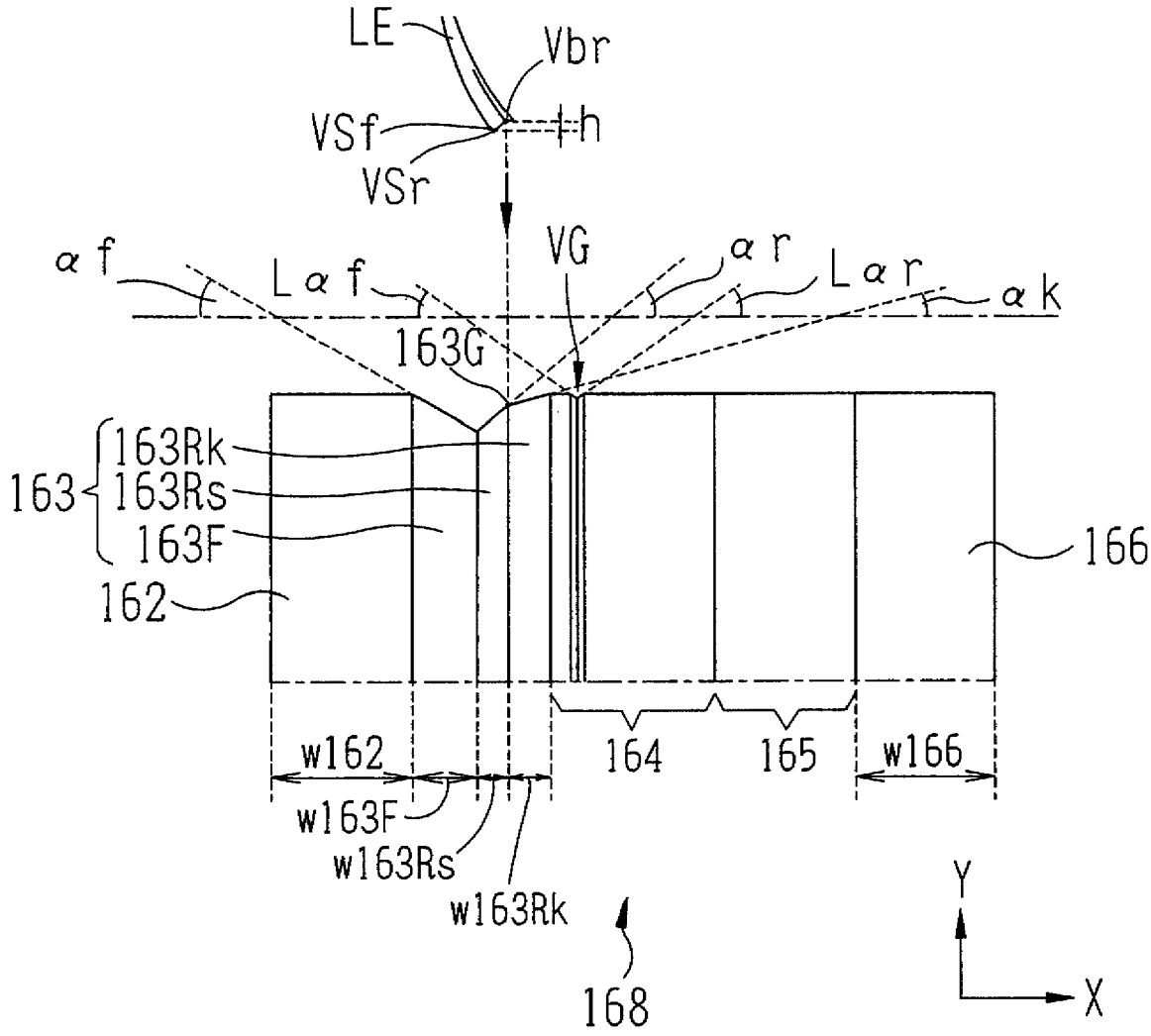
FIG. 4 is a diagram showing a configuration of a grindstone.

Next, a configuration of the grindstone group 168 will be described. FIG. 4 is a diagram showing the grindstone group 168 when viewed in a direction indicated by the arrow A shown in FIG. 1.

Regarding the beveling V groove of the low curve finishing grindstone 164, an angle Lαf of a front surface processing slope and an angle Lαr of a rear surface processing slope in an X-axis direction are set to 35° in order to have a good external appearance in case of fitting the lens into the frame having a gentle curve. A depth of the V groove VG is less than 1 mm.

The high curve bevel-finishing grindstone 163 includes a front surface beveling grindstone 163F for processing a bevel slope on the front surface side of the lens LE, a rear surface beveling grindstone 163Rs for processing a bevel slope on the front surface side of the lens LE, and a rear-surface-bevel-shoulder processing slope 163Rk for forming a bevel shoulder on the rear surface side of the lens. These grindstones are integrally formed in the present apparatus, but may be separately provided.

An angle αf of the front surface beveling grindstone 163F in an X-axis direction is gentler than the angle Lαf of the front surface processing slope of the finishing grindstone 164, and is set to, for example, 30°. Meanwhile, an angle αr of the rear surface beveling grindstone 163Rs in an X-axis direction is larger than the angle Lαr of the rear surface processing slope of the finishing grindstone 164, and is set to, for example, 45°. Then, an angle αk of the rear-surface-bevel-shoulder processing slope 163Rk in an X-axis direction is larger than an angle (0° in FIG. 3, but may be not more than 3°) of the rear-surface-bevel-shoulder processing slope of the finishing grindstone 164, and is set to, for example, 15°. Accordingly, in case of fitting the lens into the high curve frame, it is possible to obtain a good external appearance and to easily hold the lens.

A width w163F of the front surface beveling grindstone 163F in an X-axis direction is set to 9 mm, and a width w163Rs of the rear surface beveling grindstone 163Rs is set to 3.5 mm. Since the front surface bevel slope and the rear surface bevel slope are separately processed in case of the high curve lens, the width is larger than that of the low curve finishing grindstone 164 in order to prevent an interference therebetween. A width w163Rk of the rear-surface-bevel-shoulder processing slope 163Rk is set to 4.5 mm. In the present embodiment, the grindstone is used as a roughing tool and a beveling tool for forming a bevel, but a cutter may be used.

Figure 5:
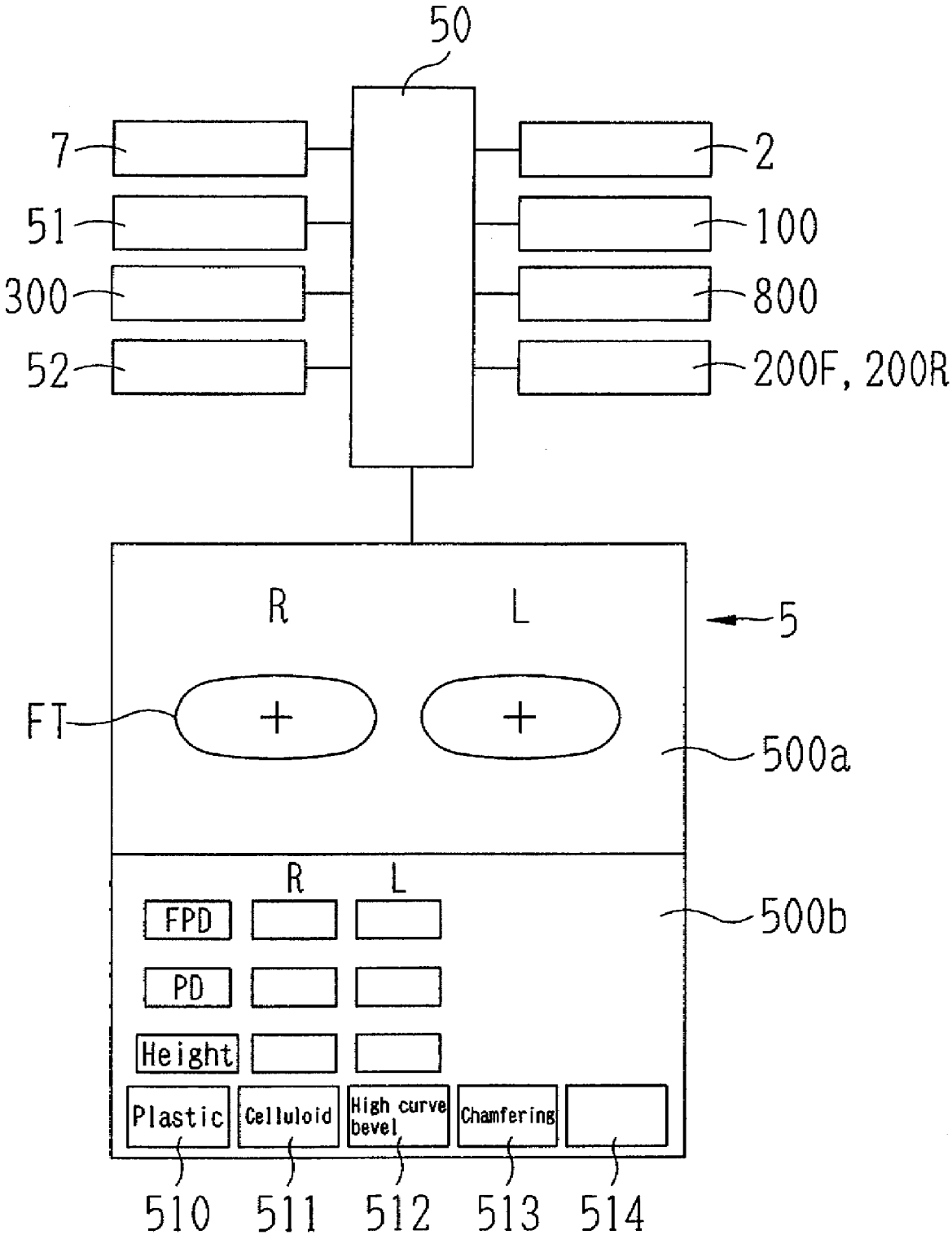
FIG. 5 is a control block diagram showing the eyeglass lens processing apparatus.

FIG. 5 is a control block diagram showing the eyeglass lens processing apparatus. A control portion 50 is connected to an eyeglass frame shape measurement portion 2 (such as the unit disclosed in Japanese Patent Application Laid-Open No. H04-93164 (U.S. Pat. No. 5,333,412)), a switch portion 7, a memory 51, the carriage portion 100, the lens edge position measurement portions 200F, 200R, the grooving mechanism portion 300, a touch-panel type display 5 as an input unit and a display unit, the drilling mechanism portion 800, and the like. The control portion 50 receives an input signal by a touch panel function of the display 5, and controls a display of information and a figure of the display 5. The control portion 50 is also used as a calculation unit for calculating a bevel path and various processing data and a control portion for controlling the respective mechanism portions.

Figure 7:
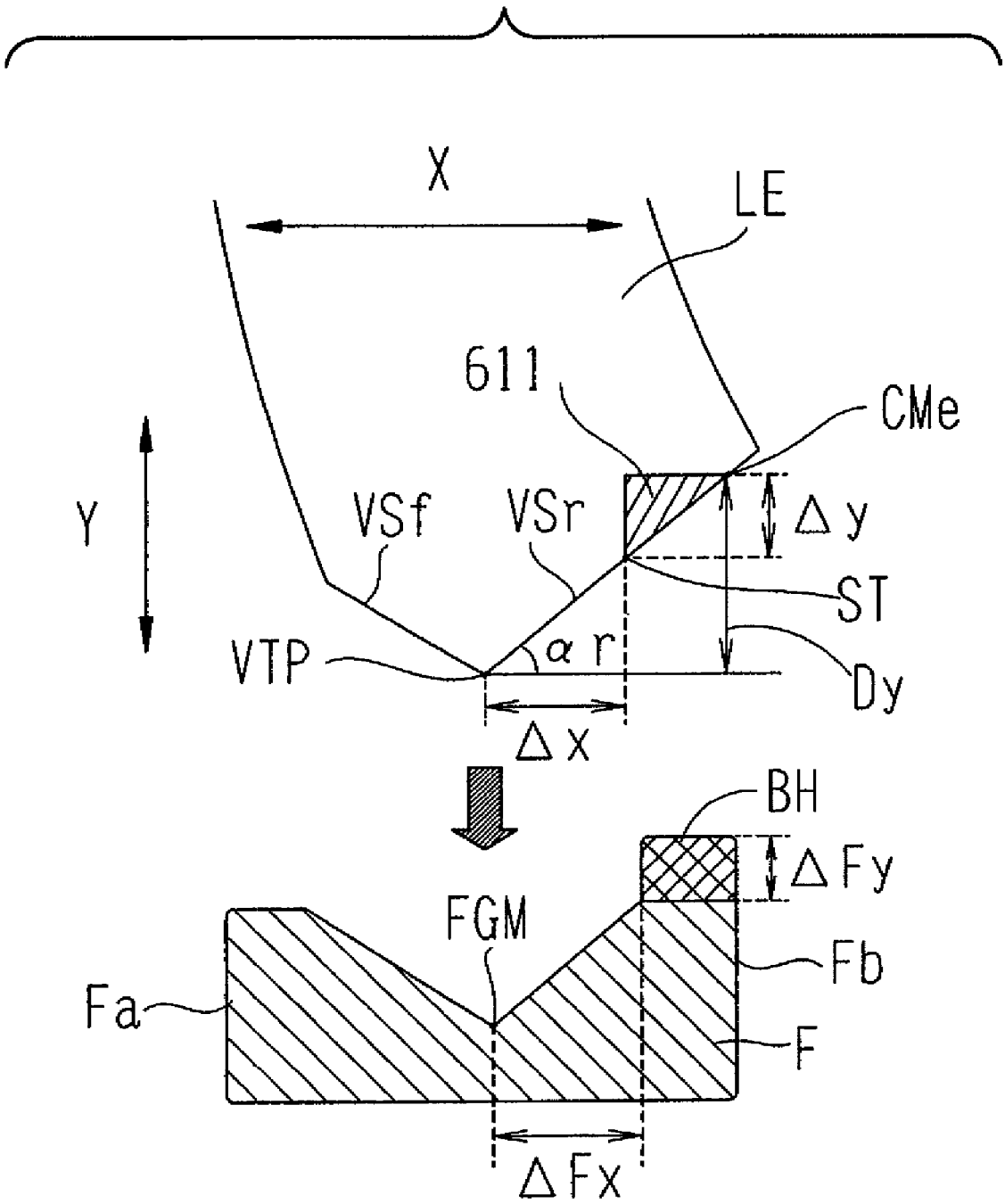
FIG. 7 is a diagram showing a high curve frame having a protrusion portion BH disposed on the rear surface side of a lens and a modifying portion in case of fitting a corrective lens into a frame.

An operation of the apparatus having the above-described configuration will be described. First, an operator inputs the target lens data of an eyeglass frame F. The target lens data of the eyeglass frame F measured by the eyeglass frame shape measurement portion 2 is input by pressing a switch of the switch portion 7, and is stored in the memory 51. A lens shape figure FT based on the input target lens data is displayed on a screen 500*a* of the display 5. Then, it becomes a state capable of inputting layout data such as a wearer's pupillary distance (PD value), a frame pupillary distance (FPD) of the eyeglass frame F, and a height of an optical center with respect to a center of a lens shape. The layout data is input by operating a predetermined touch key displayed on the screen 500*b*. A processing condition such as a lens material, a frame type, a processing mode, and a chamfering is selected by touch keys 510, 511, 512, and 513. In the processing mode using the touch key 512, the modes of a guided beveling, a high curve beveling, a flat edging, a grooving, and a drilling are selected. When the high curve beveling mode is selected by the touch key 512, it is possible to further select a processing mode (hereinafter, referred to as a bevel-modifying mode) for removing a part of the bevel shoulder and/or the bevel slope on the rear surface side of the lens by a touch key 514. As shown in FIG. 7, the bevel-modifying mode is used to perform a processing to the high curve frame F having a protrusion portion BH (a portion in which a side wall Fb on the rear surface side of the lens is larger than a side wall Fa on the front surface side of the lens) on the rear surface side of the lens in order to prevent an interference between the protrusion portion BH and the bevel slope (or the bevel shoulder) of the lens. That is, when a modifying portion 611 indicated by the hatched area is cut out so as to match with the bevel slope of the lens LE shown in FIG. 7, it is possible to prevent an interference between the protrusion portion BH and the lens in case of fitting the lens into the high curve frame. Hereinafter, a case will be described in which the high curve beveling mode and the bevel-modifying mode are selected as the processing condition.

Upon completing the data input necessary for the processing, the operator chucks the lens LE by the lens chuck shafts 102R and 102L, and operates the switch portion 7 by pressing a start switch. The control portion 50 operates the lens edge position measurement portions 200F and 200R in response to the start signal, and measures the edge positions of the front surface and the rear surface of the lens on the basis of the target lens data. The measurement positions of the front surface and the rear surface of the lens are, for example, a bevel top point position and an outside position away from the bevel top point position by a predetermined distance (0.5 mm). Subsequently, the control portion 50 carries out a bevel calculation throughout the whole circumference of the peripheral edge of the lens so as to obtain a bevel top point path on the basis of the edge position information. The configuration, the measurement operation, the bevel calculation, and the like of the lens edge position measurement portions 200F and 200R are shown in Japanese Patent Application Laid-Open No. H05-212661 (U.S. Pat. No. 5,347,762) and the like. The bevel top point path data obtained by the bevel calculation are denoted by (rn, θn, and Hn) (n=1, 2, 3, . . . , N). "rn" denotes a radial length of the target lens data, "θn" denotes a radial angle of the target lens data, and "Hn" denotes a bevel top point position data in a direction of the lens chuck shaft (in an X-axis direction).

Here, when the high curve beveling mode is selected, the bevel top point path is equal to an imitative curve of the front surface curve of the lens. The front surface curve of the lens is obtained from the front surface shape of the lens measured by the lens edge position measurement portion 200F. An initial value of the bevel top point position is set to a position in rear of the edge position of the front surface of the lens by a predetermined distance (for example, 0.3 mm). When the high curve beveling mode is selected, the bevel slope on the front surface side of the lens and the bevel slope on the rear surface side of the lens are processed by the front surface beveling grindstone 163F and the rear surface beveling grindstone 163Rs, respectively.

Figure 6:
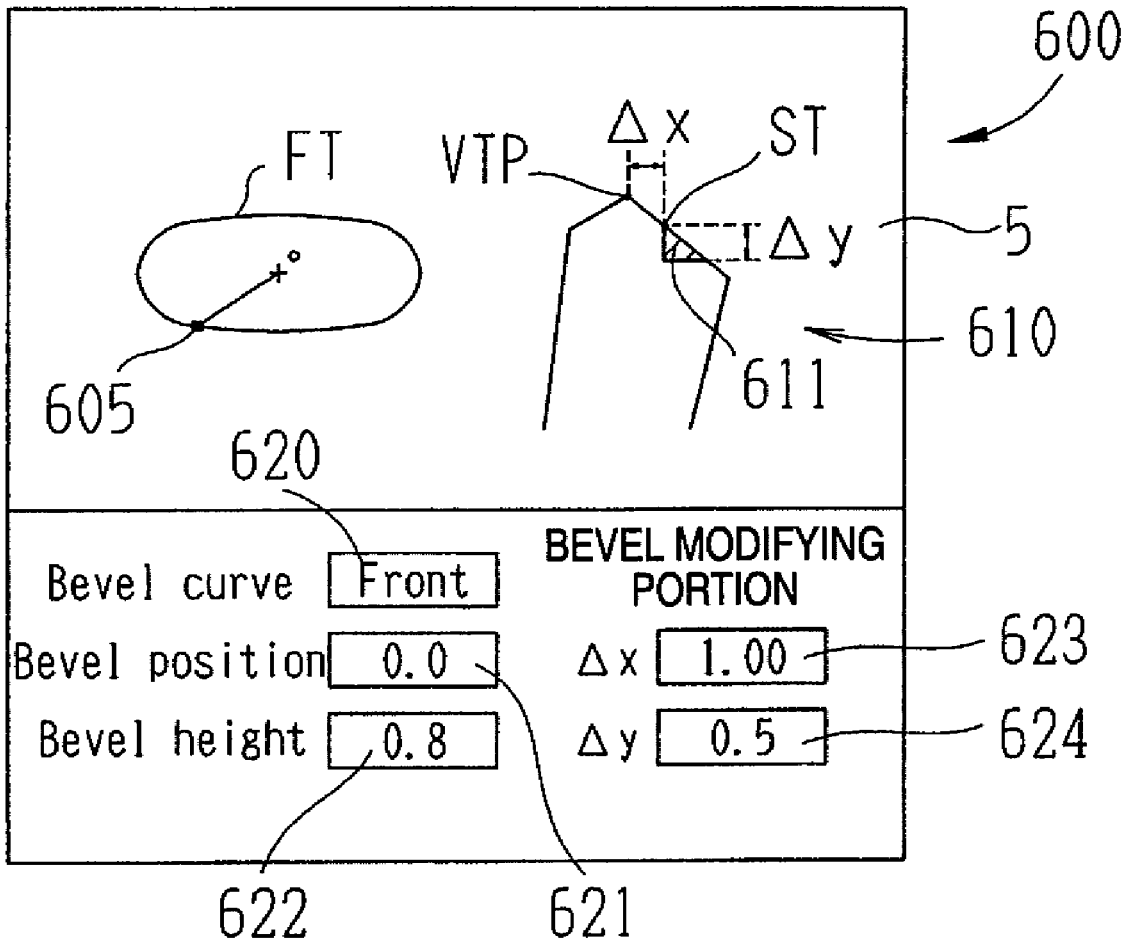
FIG. 6 is a diagram showing a display example of a bevel simulation screen.

When the bevel calculation is carried out by the control portion 50, a bevel simulation screen 600 shown in FIG. 6 is displayed on the display 5. A bevel sectional shape 610 at a position where a cursor 605 is located on the lens shape figure FT is displayed on the screen 600. The cursor 605 is moved on the lens shape figure FT by a predetermined operation using a touch pen or the like. The bevel sectional shape 610 changes in accordance with the movement of the cursor 605.

Edit boxes 620, 621, and 622 are provided at a lower portion of the screen 600 so as to input a bevel curve, a bevel top point position, and a bevel height thereto. The bevel height in the edit box 622 is provided to input a height h (see FIG. 4) from a bevel top point VTP to a bevel shoulder on the rear surface side of the lens. By changing a value of the bevel position edit box 621, it is possible to horizontally move the bevel top point position to the front surface or the rear surface of the lens.

Then, when the bevel-modifying mode is selected, edit boxes 623 and 624 used for inputting position data of the modifying portion 611 for the bevel top point VTP are displayed. The display 5 is used as a unit used for inputting data of the modifying portion 611. In order to fit the corrective lens into the frame F having the protrusion portion BH on the rear surface side of the lens shown in FIG. 7, a distance Δx from a bevel top point VTP to a start point ST of the modifying portion 611 in an X-axis direction (in a direction toward the rear surface side of the lens) is input to the edit box 623. The distance Δx can be obtained by measuring a distance ΔFx from a frame groove center FGM to the protrusion portion BH shown in FIG. 7. A distance Δy of the modifying portion 611 from the start point ST in a depth direction is input to the edit box 624. The distance Δy may be input as a depth Dy (see FIG. 7) of the modifying portion 611 from the bevel top point VTP. The distance Δy can be obtained by measuring a height ΔFy of the protrusion portion BH of the frame F shown in FIG. 7. In order to prevent an interference between the protrusion portion BH and the lens, it is desirable that the distance Δx is slightly shorter than the distance ΔFx and the distance Δy is slightly longer than the distance ΔFy. When the distances Δx and Δy are input, the figure of the modifying portion 611 is displayed on the bevel sectional shape 610. In a case where the height ΔFy of the protrusion portion BH of the frame F is not identical throughout the whole circumference of the rim of the frame F, it is possible to cope with this situation by inputting the distance Δy on the basis of a position where the height ΔFy of the protrusion portion BH is the largest. In a case where the distance ΔFx from the rim groove center FGM to the protrusion portion BH of the frame F is different at some positions, the distance Δx may be input on the basis of a position where the distance ΔFx is the shortest.

A path data calculation of the modifying portion 611 formed in the peripheral edge of the lens subjected to the beveling will be described with reference to FIG. 7. The lens LE shown in FIG. 7 corresponds to a case in which the lens is thick, and the shape of the lens subjected to the beveling is shown. In this example, the bevel shoulder on the rear surface side of the lens is not formed, but the large bevel slope VSr on the rear surface side of the lens is formed.

The bevel slope VSr on the rear surface side of the lens is processed by the rear surface beveling grindstone 163Rs so as to have an angle αr with respect to an X-axis direction. When the bevel top point path data are denoted by (rn, θn, and Hn) (n=1, 2, 3, . . . , N), the path data of the bevel-modifying start point ST on the bevel slope VSr is calculated by the control portion 50 by (rn−Δx·tan αr, θn, and Hn+Δx) (n=1, 2, 3, . . . , N). The bevel-modifying depth data Dy from the bevel top point position VTP is calculated by (Δx·tan αr+Δy). Further, the modifying portion 611 on the rear surface side of the lens is obtained so that the cutting is carried out up to the rear-surface-side edge of lens in an X-axis direction. As shown in FIG. 7, in a case where the large bevel slope VSr on the rear surface side of the lens is formed, the cutting is carried out up to a lens end CMe as an end of the bevel slope VSr in an X-axis direction.

In FIG. 6, when the cursor 605 is moved on the lens shape figure FT, the figure of the modifying portion 611 overlapping with the bevel sectional shape 610 changes on the basis of the path data of the modifying portion 611 calculated as described above. Accordingly, the operator is capable of checking a state of the modifying portion 611 throughout the whole circumference of the lens edge.

After the necessary data are input and checked by the bevel simulation screen, when a processing start switch of the switch portion 7 is pressed, the periphery of the lens LE is processed. First, the carriage 101 is moved so that the lens LE is located at a position of the plastic roughing grindstone 166, and the Y-axis movement motor 150 is controlled by the roughing control data based on the target lens shape data, thereby roughing the peripheral edge of the lens LE.

Subsequently, the beveling is carried out. When the high curve beveling mode is selected, the bevel slope on the front surface side of the lens and the bevel slope on the rear surface side of the lens are processed by the front surface beveling grindstone 163F and the rear surface beveling grindstone 163Rs, respectively. First, the carriage 101 is moved so that the lens LE is located at the position of the front surface beveling grindstone 163F. Subsequently, the X-axis movement motor 145 and the Y-axis movement motor 150 are controlled to be driven in accordance with the front surface beveling control data obtained on the basis of the bevel top point path data, and the bevel slope VSf on the front surface side of the lens is processed by the grindstone 163F by rotating the lens LE. Subsequently, the lens LE is moved to be located at the position of the rear surface beveling grindstone 163Rs. The X-axis movement motor 145 and the Y-axis movement motor 150 are controlled to be driven on the basis of the rear surface beveling control data, and the bevel slope VSr on the rear surface side of the lens is processed by the grindstone 163Rs by rotating the lens LE. When it is selected that the bevel shoulder is formed in the rear surface of the lens, the movement of the lens LE is controlled so that a bevel bottom Vbr is located at an intersection point 163G of the rear surface beveling grindstone 163Rs and the rear-surface-bevel-shoulder processing slope 163Rk. Accordingly, even in the high curve lens such as 8 curve as a curve value of the lens, the bevel is formed by restricting a bevel thinning (a phenomenon in which a width or a height of the bevel becomes small). As the calculation of the processing control data of the front surface bevel slope using the grindstone 163F and the processing control data of the rear surface bevel slope using the grindstone 163Rs, and the processing operation thereof, basically, the technique disclosed in Japanese Patent Application Laid-Open H11-48113 (U.S. Pat. No. 6,089,957) can be used, and thus the description thereof will be omitted.

When the beveling completes, the bevel-modifying is carried out by the mechanism portion 300 having the grooving grindstone 342. First, in the same manner as the grooving, the arm 320 is rotated by the pulse motor 305, thereby moving the grooving grindstone 342 from the retraction position to the processing position. The bevel-modifying control data is calculated by the control portion 50 on the basis of the bevel path data (rn, θn, and Hn) (n=1, 2, 3, . . . , N) and the position data (x and (y (or Dy) of the modifying portion 611 with respect to the bevel top point VTP.

Figure 8:
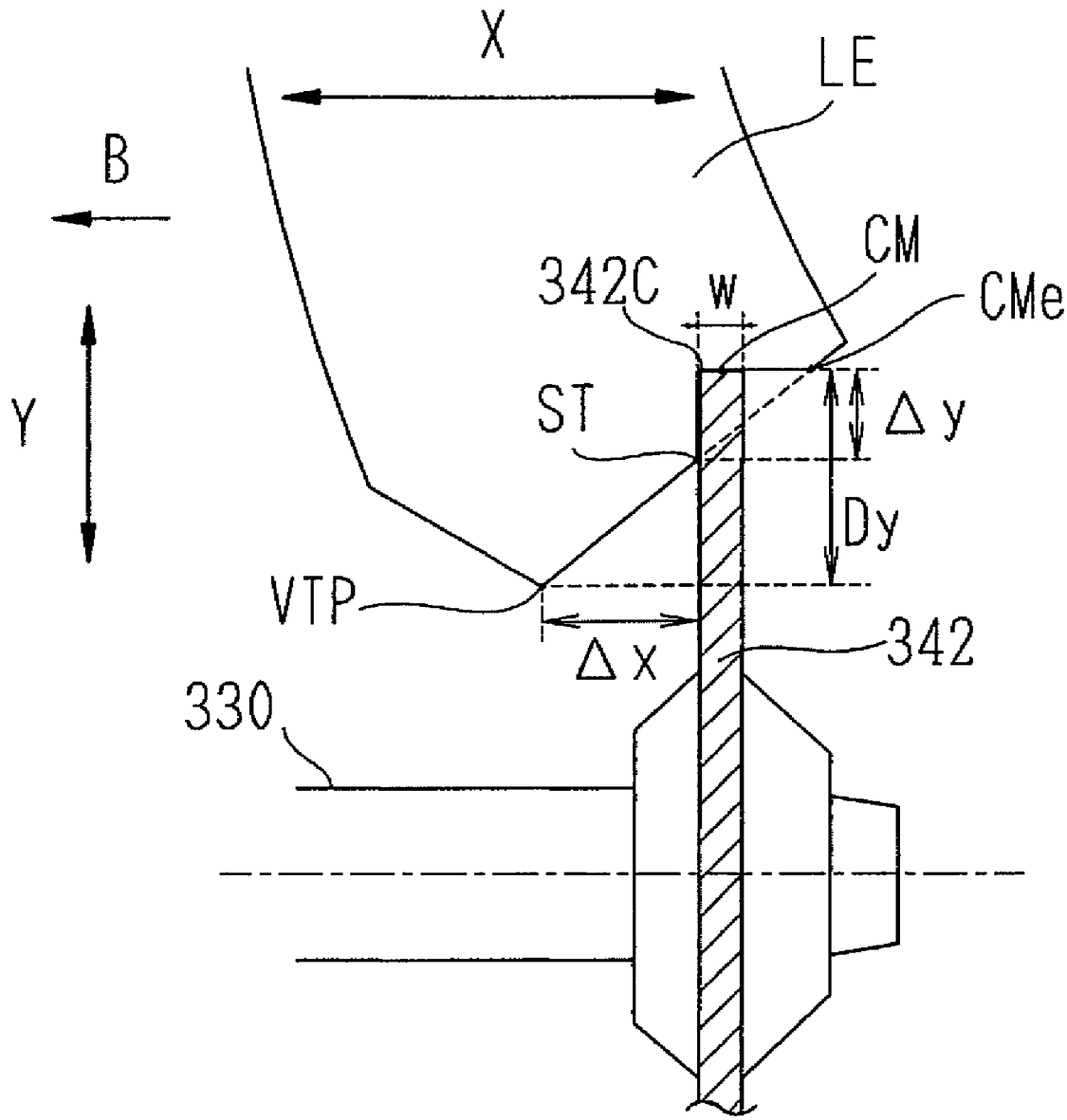
FIG. 8 is a diagram showing a bevel-modifying performed to a bevel slope on a rear surface side of the lens by a grooving grindstone.

A calculation of the bevel-modifying control data will be described. As shown in FIG. 8, the processing position CM is set to a position located on the outer-diameter side of the grooving grindstone 342 and located at the center of the grindstone width W. The path data of the processing position CM with respect to the path data of the start point ST (rn−(x (tan(r, (n, and Hn+(x) (n=1, 2, 3, . . . , N)) is obtained by (rn−(x(tan(r−(y, (n, and Hn+(x+W/2) (n=1, 2, 3, . . . , N). The processing point upon rotating the lens LE is obtained on the basis of the radius of the grooving grindstone 342 with respect to the radial data (rn−(x(tan(r−(y, (n) of the path data of the processing position CM (the method of obtaining the processing point is the same as the processing method using the roughing grindstone and the beveling grindstone). At this time, when a lens rotating angle is denoted by (i (i=1, 2, 3, . . . , N), and a distance between the lens chuck shafts 101R, 101L and the grindstone spindle 330 is denoted by Lgi, the Y-axis control data is calculated by (Lgi and (i) (i=1, 2, 3, . . . , N). The control data of the processing position CM in an X-axis direction is calculated by (Hi and (i) (i=1, 2, 3, . . . , N), where (Hn+(x+W/2) at the processing point corresponding to the lens rotating angle (i is denoted by Hi. In summary, the control data of the first processing position CM is (Lgi, Hi, and θi) (i=1, 2, 3, . . . , N).

In a case where the width of the modifying portion 611 up to the lens edge CMe on the rear surface side of the lens is larger than the width W of the grooving grindstone 342, since the modifying portion cannot be completely formed just by rotating the lens LE once, the modifying portion is formed by rotating the lens LE a plurality of times. In this case, for example, in order to move the lens chuck shafts 102L and 102R by a distance shorter than the grindstone width W in a direction indicated by the arrow B (in a direction toward the front surface side of the lens) whenever the lens LE rotates once, the control data in an X-axis direction is obtained. For example, in order to move the lens chuck shafts by a distance of ⅓ of the grindstone width W (in case of W of 0.6 mm, the movement distance is 0.2 mm), the control data in an X-axis direction is obtained. The lens end CMe is obtained by the angle (r of the bevel slope VSr on the rear surface side of the lens and the depth data (y (or Dy). In a case where the bevel shoulder is formed on the rear surface side of the lens, the edge position on the rear surface of the lens measured by the lens edge position measurement portion 200R is the lens end CMe.

Since the reason of forming the modifying portion 611 is to prevent interference between the protrusion portion BH of the frame F and the lens, it is not necessary to high-precisely obtain the path of the modifying portion 611 like the beveling or the grooving. Simply, after obtaining the movement control data in an X-axis direction and the control data of the distance Lgi between shafts in a Y-axis direction by ensuring the bevel path data (rn, θn, and Hn) (n=1, 2, 3, . . . , N) at an outer-diameter shoulder portion 342C (a side angular portion located on the front surface side of the lens) of the grooving grindstone 342, the control data in an X-axis direction is made to be shifted to the rear surface side of the lens by (x, and the control data of the distance Lgi between shafts in a Y-axis direction is made to be shorter by the depth Dy. That is, when the control data upon ensuring the bevel path data is denoted by (LYgi, HYi, and θi) (i=1, 2, 3, . . . , N), the control data of the first modifying portion is obtained by (LYgi-Dy, HYi+(x, and θi,) (i=1, 2, 3, . . . , N). Then, in order to carry out the bevel-modifying up to the lens end CMe by the grooving grindstone 342, the control data for moving the lens chuck shafts 102L and 102R in a direction indicated by the arrow B whenever the lens rotates once is obtained.

On the basis of the control data obtained as described above, the control portion 50 controls the motor 120 for rotating the lens chuck shafts 102L and 102R, and controls the motors 145 and 150 respectively moving the lens chuck shafts 102L and 102R in an X-axis direction and a Y-axis direction. Accordingly, the modifying portion 611 is processed by the depth Δy by the grooving grindstone 342 by ensuring the processing start point ST. In a case where the modifying portion 611 is thicker than the width W of the grooving grindstone 342, the modifying portion 611 ensured up to the lens end CMe is processed by the grooving grindstone 342 by moving the lens chuck shafts 102L and 102R in a direction indicated by the arrow B on the basis of the grindstone width W whenever the lens LE rotates once.

As shown in FIG. 7, even in the corrective lens, it is possible to fit the lens into the high curve frame having the protrusion portion BH on the rear surface side of the lens. It is possible to easily carry out the bevel-modifying without operator's particular skill.

In FIG. 8, it is described that the grindstone spindle 330 is in parallel to an X-axis direction (a direction of the lens chuck shaft). However, as shown in FIG. 3, in a case where the grindstone spindle 330 is inclined at an angle $\alpha$ with respect to an X-axis direction, it is desirable to obtain the processing control data for modifying the inclined angle $\alpha$. The modifying method is carried out in the same manner as the technique disclosed in Japanese Patent Application Laid-Open No. 2005-74560 (EP 1510290A1), where since the outer diameter of the grooving grindstone 342 is formed in an oval shape due to the inclined angle $\alpha$ when the grooving grindstone 342 is viewed in an X-axis direction, in case of the grindstone 342 having the outer diameter formed in an oval shape, the processing point of the rotating angle $\theta i$ of the lens LE is obtained, and the control data in a Y-axis direction is calculated. In the same manner, since the outer diameter of the grooving grindstone 342 is formed in an oval shape due to the inclined angle $\alpha$ even when the grooving grindstone 342 is viewed in a Y-axis direction, in case of the grindstone 342 having the outer diameter formed in an oval shape, the processing point of the rotating angle $\theta i$ of the lens LE is obtained, and the control data in an X-axis direction is calculated.

In the above description, the grindstone 342 is used as the bevel-modifying tool, but a cutter may be used instead of the grindstone 342. As the bevel-modifying mechanism, a type may be employed in which the rotating shaft mounted with the grindstone or the cutter is moved in a Y-axis direction and an X-axis direction, instead of the type in which the lens chuck shafts 102R and 102L are moved in a Y-axis direction and an X-axis direction.

Figure 9:
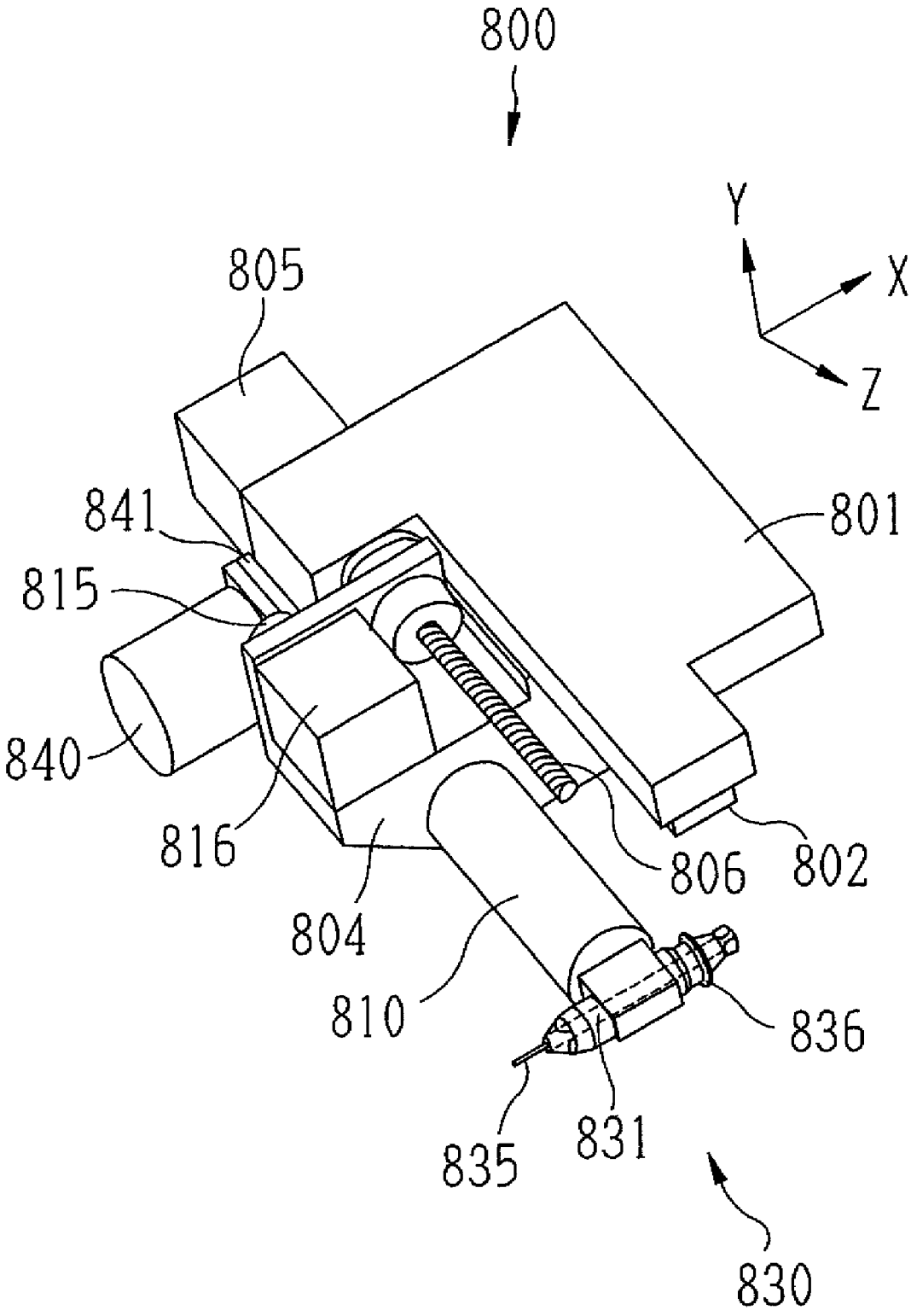
FIG. 9 is a configuration diagram showing a case where an end mill of a drilling tool is also used as a bevel-modifying tool.

The bevel-modifying mechanism portion, which is also used as the drilling mechanism portion 800, may be employed. FIG. 9 is a configuration diagram showing a case where an end mill of a drilling tool is also used as a bevel-modifying tool.

In FIG. 9, a fixed plate 801 as a base of the mechanism portion 800 is fixed to a block (not shown) uprightly provided in the base 170 shown in FIG. 1. A rail 802 extending in a Z-axis direction (a direction perpendicular to an X-Y plane) is fixed to the fixed plate 801, and a Z-axis movement support base 804 slidably mounted to the rail 802. The movement support base 804 is moved in a Z-axis direction in such a manner that a motor 805 rotates a ball screw 806. A rotating support base 810 is rotatably supported to the movement support base 804. The rotating support base 810 is rotated about a shaft, via a rotation transmission mechanism, by a motor 816.

A rotating portion 830 is attached to a front end portion of the rotating support base 810. A rotating shaft 831, disposed in a direction perpendicular to an axial direction of the rotating support base 810, is rotatably supported to the rotating portion 830. An end mill 835 as a drilling tool is coaxially attached to one end of the rotating shaft 831. The end mill 835 has a diameter of 0.8 mm which is suitable for the drilling. Then, the end mill 835 is also used as a bevel-modifying tool. A grooving cutter 836 as a grooving tool is coaxially attached to the other end of the rotating shaft 831. In a case where the grooving tool is provided in the mechanism portion 300 shown in FIG. 3, the bevel-modifying end mill may be provided instead of the grooving cutter 836. In this case, since the end mill is not used as the drilling tool, the end mill having a thick diameter of 2 mm may be used. The rotating shaft 831 is rotated by the rotating portion 830 and the rotating support base 840. As a configuration of the drilling mechanism portion 800, the basic configuration is shown in Japanese Patent Application Laid-Open No. 2003-145328 (US 2003-087584), and thus the description thereof will be omitted.

Next, a bevel-modifying operation using the end mill 835 will be described with reference to FIG. 10. In case of carrying out the bevel-modifying, as described above, the data of $\Delta x$ in an X-axis direction and the data of $\Delta y$ in a Y-axis direction of the bevel-modifying are input in terms of the bevel simulation screen shown in FIG. 6.

After the beveling, when the bevel-modifying is carried out, the control portion 50 controls the motor 805 to be driven, and controls the rotating portion 830 to move from a retraction position to a processing position. Subsequently, when the motor 816 is driven, as shown in FIG. 10 the shaft (the rotating shaft 831) of the end mill 835 is identical with a Y-axis direction on the X-Y plane of the X and Y axes, and the front end of the end mill 835 is disposed so as to face the lens LE.

Figure 10:
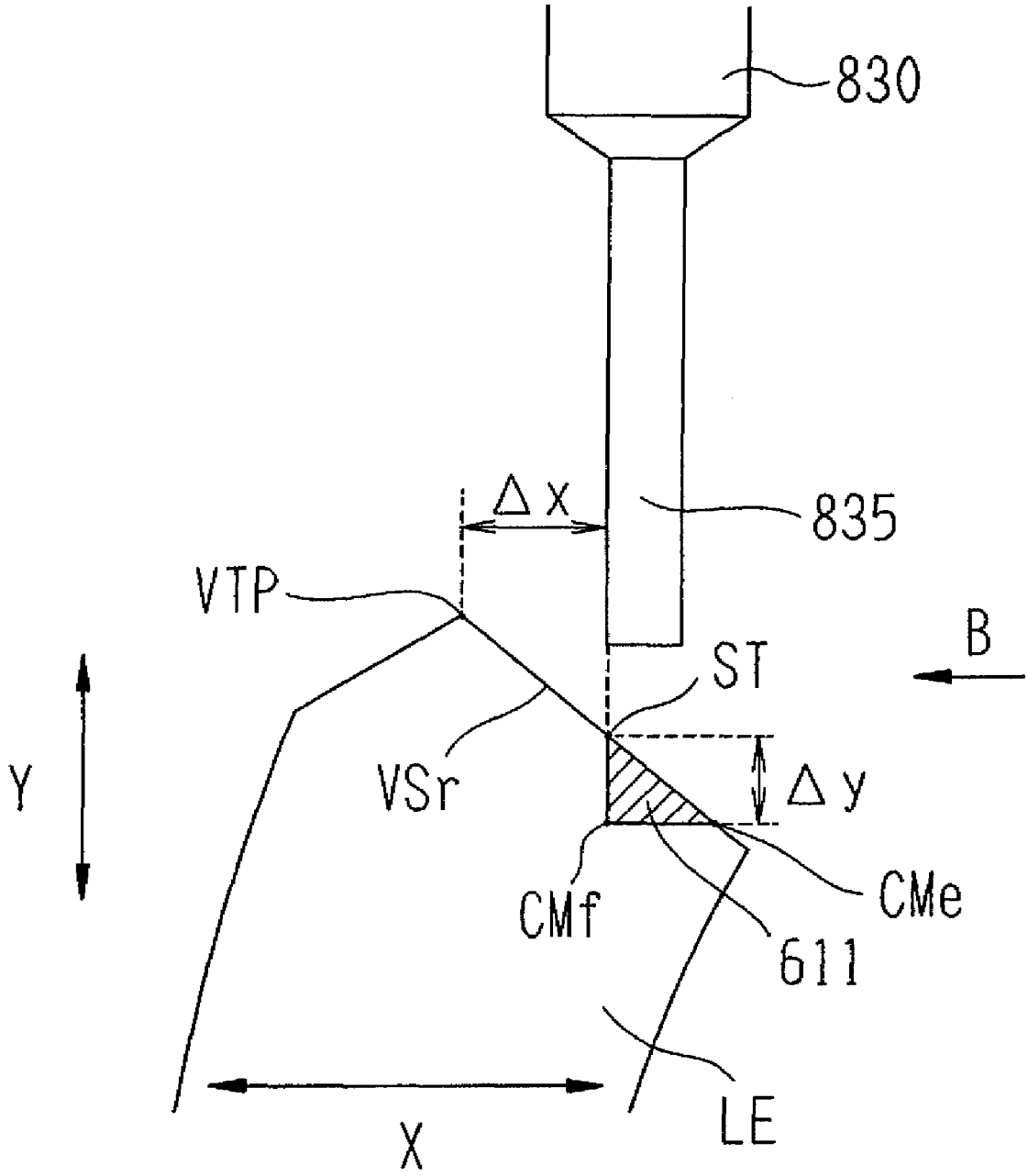
FIG. 10 is a diagram showing a bevel-modifying using the end mill.

In FIG. 10, when the path data of the bevel top point VTP is denoted by (rn, $\theta$n, and Hn) (n=1, 2, 3, . . . , N), the path data of the bevel-modifying start point ST on the bevel slope VSr is calculated by the control portion 50 by (rn$-\Delta x\cdot\tan\alpha r$, $\theta$n, and Hn$+\Delta x$) (n=1, 2, 3, . . . , N) as described above. A path data of a processing position CMf in which the cutting is carried out from the start point ST by a depth $\Delta y$ is calculated by the control portion 50 by (rn$-\Delta x\cdot\tan\alpha r-\Delta y$, $\theta$n, and Hn$+\Delta x$) (n=1, 2, 3, . . . , N). Then, the control data in an X-axis direction and a Y-axis direction are calculated in the same manner as the beveling on the basis of the path data of the processing position CMf so that the side surface and the front end surface of the end mill 835 are located at the processing position CMf. In a case where a distance from the start point ST to the lens end CMe is larger than a diameter of the end mill 835, the control data for moving the lens chuck shafts 102L and 102R in a direction indicated by the arrow B whenever the lens LE rotates once is obtained.

At the initial position upon starting the processing, the lower portion of the bevel slope VSr is processed by the depth $\Delta y$ by the rotation of the end mill 835 by moving the lens chuck shafts 102L and 102R toward the end mill 835 in a Y-axis direction in a state where the lens LE does not rotate. Subsequently, the modifying portion 611 is processed throughout the whole circumference of the lens LE so as to have a width corresponding to the diameter of the end mill 835 by moving the lens chuck shafts 102L and 102R in a Y-axis direction and an X-axis direction in accordance with the control data in a Y-axis direction and an X-axis direction while rotating the lens LE. In a case where the modifying portion 611 is not cut out just by one rotation of the lens LE, in the same manner as the processing using the grooving grindstone 342 described above, the lens LE is moved in a direction indicated by the arrow B until the cutting is carried out up to the lens end CMe of the bevel slope VSr. Subsequently, the modifying portion 611 is processed throughout the whole circumference of the lens LE by the end mill 835 by moving the lens chuck shafts 102L and 102R in a Y-axis direction and an X-axis direction in accordance with the control data in a Y-axis direction and an X-axis direction while rotating the lens LE again.

Figure 11:
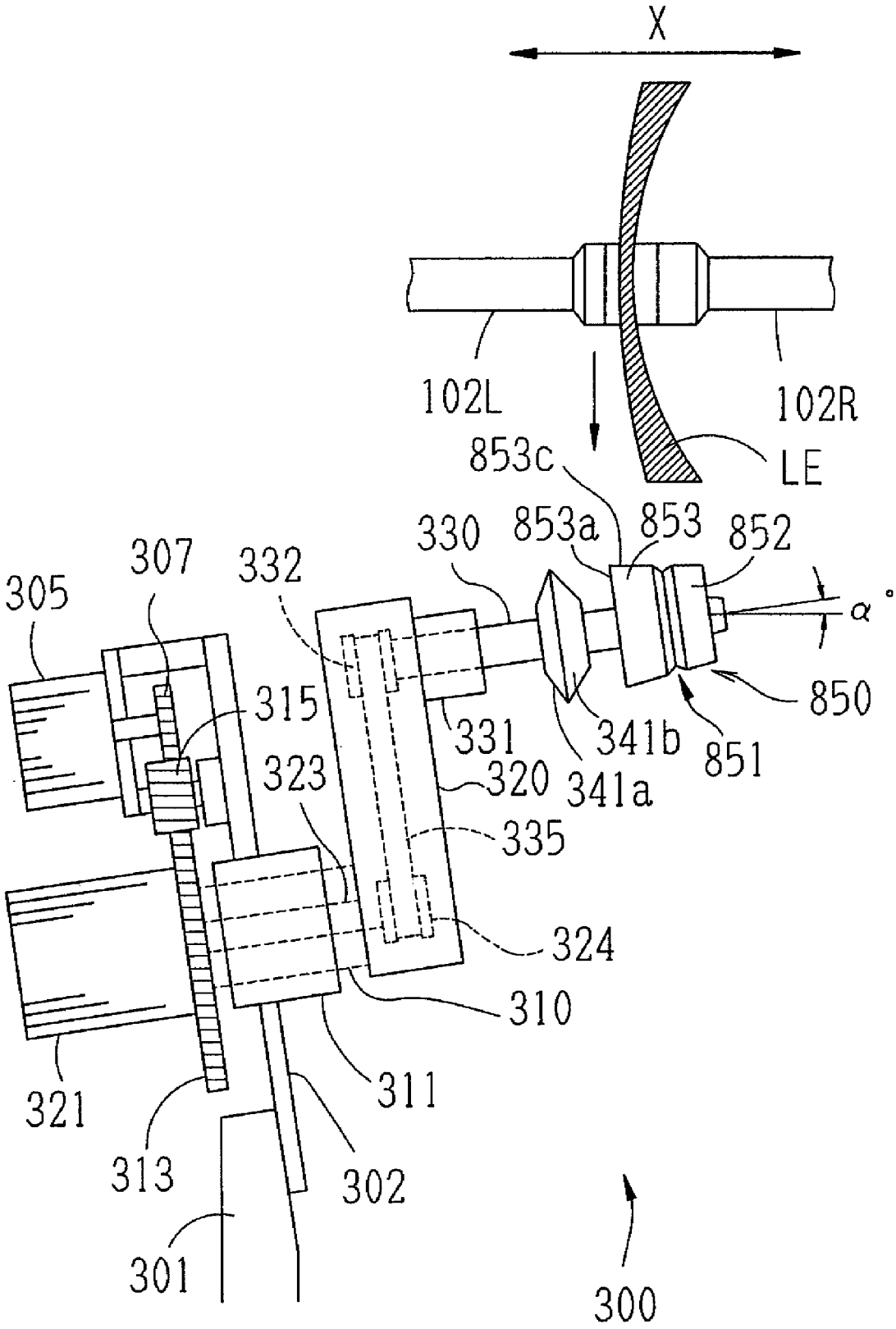
FIG. 11 is a diagram showing a configuration example of a bevel-modifying tool and a beveling tool for the high curve lens.

Another modified example will be described. FIG. 11 is a diagram showing another configuration example of the beveling tool and the bevel-modifying tool for the high curve lens. The configuration of in FIG. 11 is the same as that of FIG. 3 except that a small-diameter beveling grindstone 850 is attached to the rotating shaft 330 instead of the grooving grindstone 342 of the mechanism portion 300 shown in FIG. 3, and thus the description thereof will be omitted.

In FIG. 11, an outer diameter of the beveling grindstone 850 is smaller than that of the low curve beveling grindstone 164 shown in FIG. 4, and is, for example, about 30 mm. The small-diameter beveling grindstone 850 includes a V groove (bevel groove) 851 having a depth used to obtain a bevel height of 1 mm or so. The lens front surface bevel slope having the V groove 851 is formed to be the same as the front surface beveling grindstone 163F having an angle $\alpha f$ shown in FIG. 4, and the rear surface bevel slope of the V groove 851 is formed to be the same as the rear surface beveling grindstone 163Rs having an angle $\alpha r$. In order to form the bevel shoulder on the front surface side and the rear surface side of the lens, conical grindstone 852 and 853 are incorporated into both side portions of the V groove. The conical surfaces of the grindstone 852 and 853 are formed to be substantially parallel to a direction of the lens chuck shafts 102L and 102R (an X-axis direction).

The grindstone 853 disposed on the front surface side of the lens is also used as the bevel-modifying tool. For this reason, it is desirable that the conical surface 853*c* of the grindstone 853 is formed to have a width of 3 mm or more. It is desirable that an end surface 853*a* on the front surface side of the lens is formed on the grindstone surface. That is, the grindstone 853 is used as the bevel-modifying tool having a chevron shape and including a processing surface (853*c*) for forming the modifying portion in the lens so as to substantially parallel to the lens chuck shaft and a processing surface (853*a*) for forming the modifying portion in the lens so as to be substantially perpendicular to the lens chuck shaft.

In a case where the beveling is performed to the lens LE by the small-diameter beveling grindstone 850 shown in FIG. 11, the movement of the lens chuck shafts 102L and 102R is controlled on the basis of the control data in an X-axis direction and a Y-axis direction calculated by the bevel top point path data. Accordingly, the high curve bevel corresponding to the high curve lens is formed in the peripheral edge of the lens. The control data during the beveling using the small-diameter beveling grindstone 850 is obtained in the same manner as disclosed in Japanese Patent Application Laid-Open No. 2005-74560 (EP 1510290A1).

Next, the bevel-modifying using the grindstone 853 of the small-diameter beveling grindstone 850 will be described with reference to FIG. 12. In case of carrying out the bevel-modifying, as described above, the data of $\Delta x$ in an X-axis direction and the data of $\Delta y$ in a Y-axis direction for the bevel-modifying are input in terms of the bevel simulation screen shown in FIG. 6.

Figure 12:
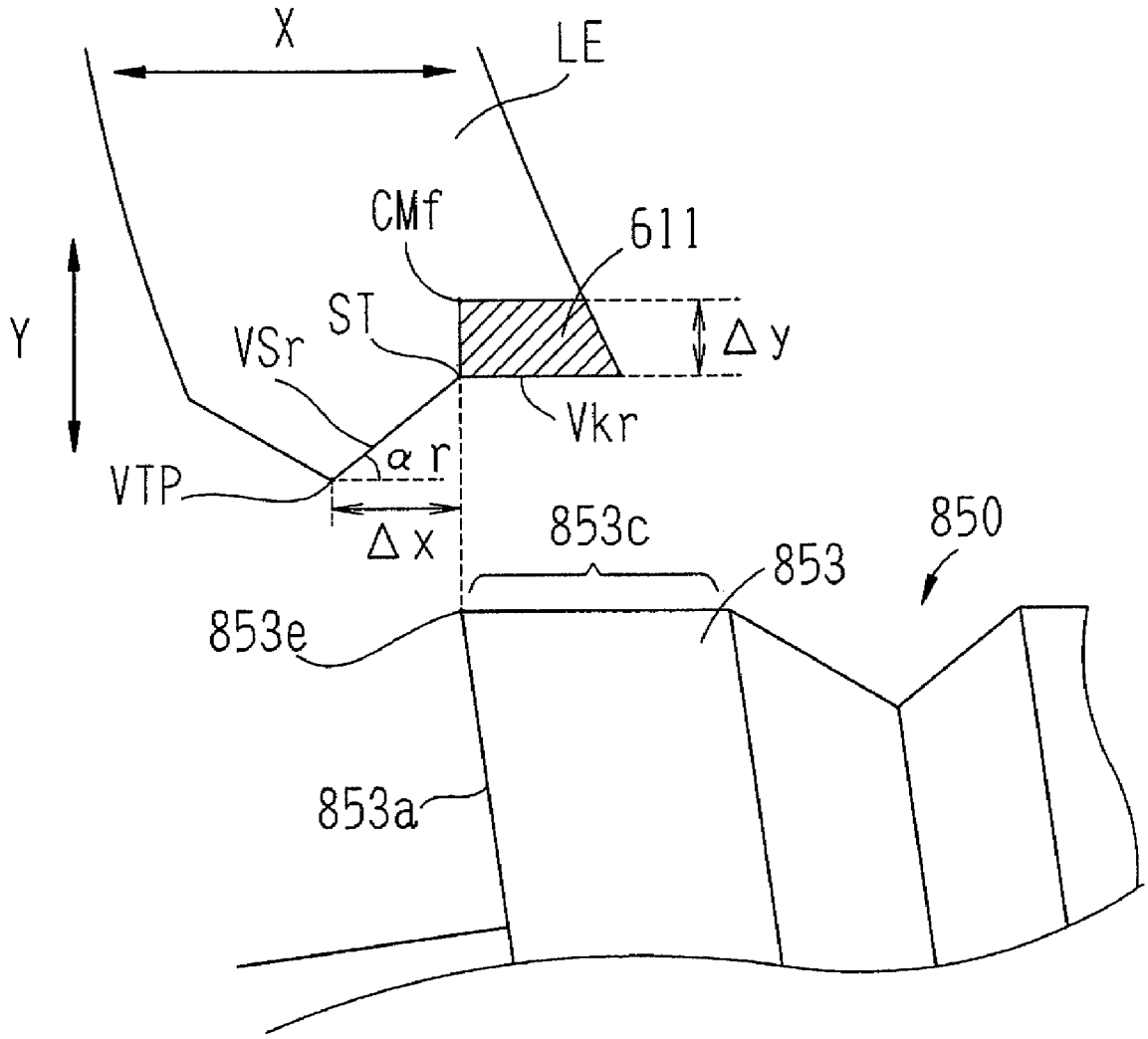
FIG. 12 is a diagram showing the bevel-modifying using a small-diameter beveling grindstone.

In FIG. 12, when the bevel top point path data are denoted by ($rn$, $\theta n$, and $Hn$) ($n=1, 2, 3, \ldots, N$), the path data of the bevel-modifying start point ST on the bevel slope VSr is calculated by the control portion 50 by ($rn-\Delta x \cdot \tan \alpha r$, $\theta n$, and $Hn+\Delta x$) ($n=1, 2, 3, \ldots, N$) as described above. In FIG. 12, the start point ST is set to the intersection point of the bevel slope VSr on the rear surface side of the lens and the bevel shoulder VKr on the rear surface side of the lens. A path data of a processing position CMf in which the cutting is carried out from the start point ST by a depth $\Delta y$ is calculated by the control portion 50 by ($rn-\Delta x \cdot \tan \alpha r-\Delta y$, $\theta n$, and $Hn+\Delta x$) ($n=1, 2, 3, \ldots, N$). Then, the control data in an X-axis direction and a Y-axis direction are calculated in the same manner as the beveling on the basis of the path data of the processing position CMf so that an edge position 853*e* between the conical surface 853*c* and the end surface 853*a* of the grindstone 853 is located at the processing position CMf. The modifying portion 611 is processed by the grindstone 853 by moving the lens chuck shafts 102L and 102R in a Y-axis direction and an X-axis direction while rotating the lens LE on the basis of the control data. The control data for moving the lens chuck shafts 102L and 102R in an X-axis direction and a Y-axis direction may be simply obtained in the same manner as the case of the grooving grindstone 342

In FIG. 12, although the grindstone 853 forming a part of the beveling grindstone 850 is used as the bevel-modifying tool, the private-use grindstone 853 having the chevron shape and including the processing surface (853*c*) and the processing surface (853*a*) may be provided. Then, the grindstone 853 may be disposed on the rotating shaft 831 of the mechanism portion 800 having the end mill 835 shown in FIG. 9.

Even in the corrective lens, by carrying out the bevel-modifying as described above, it is possible to fit the lens into the high curve frame having the protrusion portion BH on the rear surface side of the lens as shown in FIG. 7. Further, it is possible to easily carry out the bevel-modifying without operator's particular skill.

Furthermore, in the above description, the edit boxes 623 and 624 on the screen shown in FIG. 6 are used to input the position data of the bevel-modifying portion. However, if it is possible to obtain the design data of the high curve frame F having the protrusion portion BH from a maker, the design data sent from the frame maker may be input in terms of a receiving unit 52 (see FIG. 5). The design data includes the position of the bevel-modifying portion. In this case, even when the distance $\Delta Fx$ and the depth $\Delta Fy$ of the protrusion portion BH of the frame F are different in some positions, it is possible to calculate the control data in an X-axis direction and a Y-axis direction by obtaining the shape of the modifying portion 611 corresponding to the different portion throughout the whole circumference of the lens LE.

What is claimed is:

1. An eyeglass lens processing apparatus comprising:

a lens chuck shaft which holds and rotates an eyeglass lens;

a lens edge position detection unit which detects edge positions of a front surface and a rear surface of the lens on the basis of target lens shape data;

a processing tool which processes a peripheral edge of the lens and includes a roughing tool, a beveling tool, a bevel-modifying tool and a chamfering tool, the bevel-modifying tool including a grindstone or a cutter and configured to remove a part of at least one of a bevel shoulder and a periphery of a bevel slope on the rear surface side of the lens subjected to beveling;

a selection unit which is used to select a processing mode including a high curve beveling mode for forming a bevel in the lens fitted into a high curve frame having a protrusion portion in which a side wall of the frame on the rear surface side of the lens is larger than a side wall of the frame on the front surface side of the lens;

a modifying portion data input unit including a display for displaying a screen for inputting positional data of a portion of the lens to be modified in a cross sectional direction of the lens, the positional data including data of a modifying portion of the lens for removing the part of at least one of the periphery of the bevel slope and the bevel shoulder so as to prevent an interference between the bevel shoulder or the bevel slope on the rear surface side of the lens and the protrusion portion of the high curve frame;

a calculation unit which obtains path data the bevel to be formed in the peripheral edge of the lens on the basis of the edge positions of the front surface and the rear surface of the lens obtained by the edge position detection unit, and obtains path data of the modifying portion for the bevel-modifying tool on the basis of the path data of the bevel and the data of the modifying portion, in the high curve beveling mode; and a processing control unit which performs the beveling to the peripheral edge of the lens by the beveling tool in accordance with the beveling data, and removes the modifying portion on the rear surface side of the lens by the bevel-modifying tool in accordance with the bevel-modifying data.

2. The eyeglass lens processing apparatus according to claim 1, wherein the screen of the modifying portion data input unit is used to input, as data of the modifying portion, a distance $\Delta x$ from a top point of the bevel in a direction toward the rear surface side of the lens and a distance $\Delta y$ from the top point of the bevel in a depth direction.

3. The eyeglass lens processing apparatus according to claim 1, wherein the bevel-modifying tool includes a chevron shape processing tool which includes a first processing surface for forming a first part of the modifying portion in the lens so as to be substantially perpendicular to the lens chuck shaft and a second processing surface for forming a second part of the modifying portion in the lens so as to be substantially parallel to the lens chuck shaft, and the modifying portion data input unit is used to input the positional data of the first part and the second part of the modifying portion.

4. The eyeglass lens processing apparatus according to claim 1, further comprising a grooving tool for forming a groove in the peripheral edge of the lens or a drilling tool for drilling a refractive surface of the lens, wherein the grooving tool or the drilling tool is used as the bevel-modifying tool.

5. The eyeglass lens processing apparatus according to claim 1, wherein the display displays the simulation screen including a bevel sectional diagram and a modifying portion diagram.

* * * * *